United States Patent [19]

Benoit

[11] Patent Number: 4,991,401

[45] Date of Patent: Feb. 12, 1991

[54] PROCESS AND APPARATUS FOR OBTAINING VERY LOW TEMPERATURES

[75] Inventor: Alain Benoit, Eybens, France

[73] Assignee: Centre National D'Etudes Spatiales, Paris, France

[21] Appl. No.: 423,441

[22] PCT Filed: Feb. 2, 1989

[86] PCT No.: PCT/FR89/00034

§ 371 Date: Sep. 25, 1989

§ 102(e) Date: Sep. 25, 1989

[30] Foreign Application Priority Data

Feb. 2, 1988 [FR] France ..... 88 01232

[51] Int. Cl.[5] ..... F25B 19/00

[52] U.S. Cl. ..... 62/51.3; 62/467

[58] Field of Search ..... 62/51.3, 467

[56] References Cited

U.S. PATENT DOCUMENTS

| | | | |
|---|---|---|---|
| 3,195,322 | 7/1965 | London et al. | 62/467 |
| 3,581,512 | 6/1971 | Staas et al. | 62/51.3 |
| 3,992,893 | 11/1976 | Claudet et al. | 62/51.3 |
| 4,047,394 | 9/1977 | Severijns et al. | 62/51.3 |
| 4,296,609 | 10/1981 | Severijns et al. | 62/51.3 |
| 4,297,856 | 11/1981 | Staas et al. | 62/51.3 |
| 4,672,823 | 6/1987 | Benoit et al. | 62/51.3 |
| 4,770,006 | 9/1988 | Roach et al. | 62/51.3 |

FOREIGN PATENT DOCUMENTS

| | | |
|---|---|---|
| 0089391 | 9/1983 | European Pat. Off. . |
| 2176809 | 11/1973 | France . |

OTHER PUBLICATIONS

Cryogenics, vol. 20, No. 3, 3/1980, pp. 115–121.
Physics Letters, vol. 53A, No. 4, 6/1975, pp. 327–328.
Cryogenics, vol. 20, No. 3; 3/1980, pp. 153–157.

*Primary Examiner*—Ronald C. Capossela
*Attorney, Agent, or Firm*—Watson, Cole, Grindle & Watson

[57] ABSTRACT

Process and apparatus for obtaining very low temperatures by making use of the endothermic dissolution of 3He in 4He. A mixing box placed in a vacuum enclosure cooled to approximately 2° K. or less receives continuously liquid 3He and 4He via separate conduits. The solution produced is extracted therefrom via a third conduit at a rate such that, bearing in mind the diameter of the conduit, 3He cannot diffuse countercurrentwise in the solution sufficiently to raise appreciably the content of 3He in the liquid 4He introduced and to reduce the dissolution in this 4He of the liquid 3He introduced simultaneously.

8 Claims, 1 Drawing Sheet

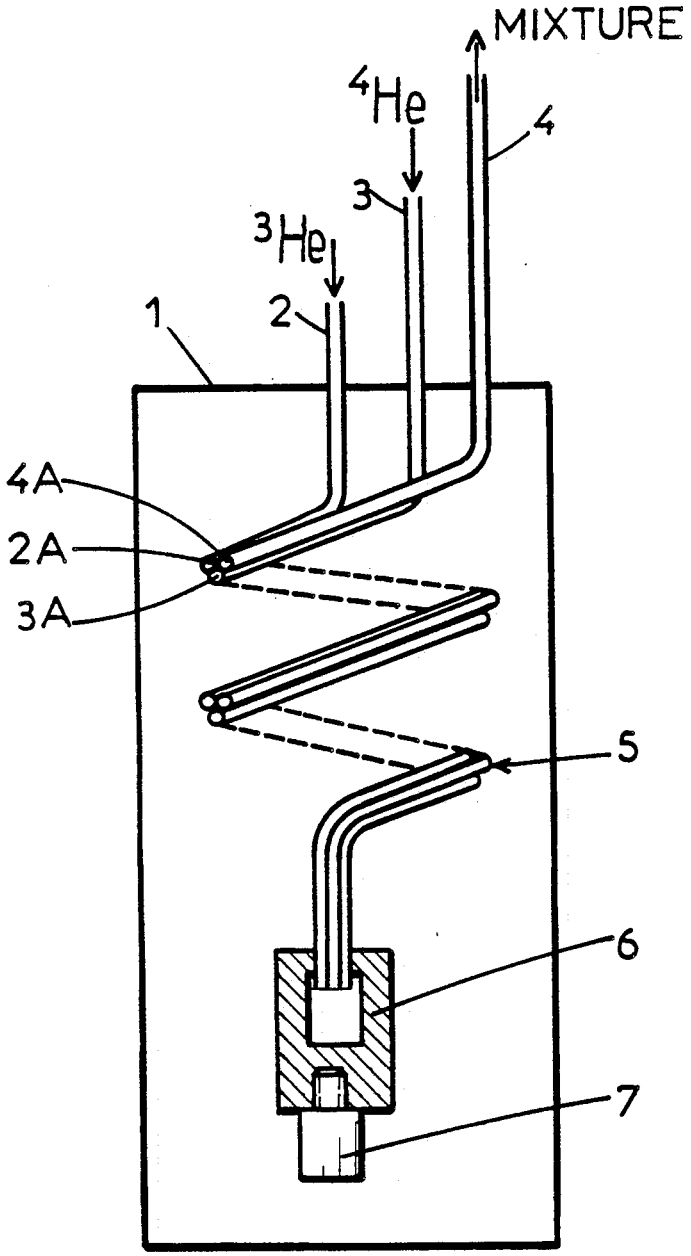
MIXTURE
$^4$He
$^3$He
1
2
3
4
4A
2A
3A
5
6
7

PROCESS AND APPARATUS FOR OBTAINING VERY LOW TEMPERATURES

The present invention relates to a process and an apparatus for obtaining very low temperatures.

Among the methods for obtaining very low temperatures, one of the most advantageous makes use of the dilution of the isotope 3He in ordinary helium 4He. Below approximately 2.17° K., a 4He-3He mixture exhibits two phases, the limiting content of 3He in 4He being approximately 6%.

To describe the principle of known processes in a somewhat simplistic manner, let us assume that, in a "mixing box" placed in a vacuum enclosure cooled to a temperature of the order of 2° K. or less, there are 3He and 4He in such quantities that there are two phases, a "solution" phase and a pure 3He phase, if we decrease the concentration of 3He in the solution phase, pure 3He will dissolve therein to reestablish the equilibrium concentration, and the energy needed for this dissolution will be taken from the mixing box, which will consequently be cooled.

The word "solution" is employed to simplify matters, it is known that the usual definitions do not apply well at very low temperatures.

In practice, the mixing box is used in combination with a column filled with solution at equilibrium, and at the top of which is placed an evaporator which allows 3He to be extracted from the solution. A concentration gradient is created in the column, and 3He migrates from the mixing box towards the evaporator, which results in the dissolution of pure 3He and the cooling of the mixing box.

For such a device, or cryostat, to operate continuously, it suffices to introduce liquid 3He into the mixing box, optionally mixed with a little 4He, to compensate for escapes.

It would be possible to, in a similar manner, operate a cryostat in which the mixing box contained a solution phase and a pure 4He phase.

With such cryostats, the presence of a distillation unit requires a pumping unit incorporating large-diameter pipes, and makes operation in all orientations or in the absence of gravity (for example use in space) difficult, or even impossible.

The purpose of the invention is to make it possible to get rid of these constraints by the construction of a cryostat comprising neither a distiller nor a low-pressure pumping line.

To obtain this result, the invention provides a process for obtaining very low temperatures, according to which there is created, in a mixing box placed in a vacuum enclosure cooled to a temperature of the order of 2° K. or lower, a two-phase system comprising a phase of solution of 3He in liquid 4He, and a liquid phase consisting of the pure isotope 3He, this isotope is transferred into the solution phase, the energy of dissolution being taken from the mixing box in order to cool it, 3He is extracted from the mixing box in the state of solution and the 3He in the pure liquid state is introduced into the mixing box in a quantity equal to the quantity of this isotope which leaves the mixing box through the solution, a feature of this process being that the two-phase system is created by continuously feeding the mixing box with liquid 4He and 3He which are introduced separately, in that the solution phase is extracted in such velocity conditions that the 3He which it contains cannot diffuse countercurrentwise sufficiently in the solution to raise appreciably the content of 3He in the liquid 4He introduced and reduce the dissolution, in this 4He, of the liquid 3He introduced simultaneously.

The process of the invention introduces appreciable differences from the prior art. In both cases, an attempt is made to have a 4He with a low content of 3He, and in which the liquid 3He introduced will be capable of dissolving easily, with production of cold.

In the prior art, the content of 3He is lowered by making the latter diffuse through the solution in the direction of an evaporator. According to the invention, on the other hand, the solution is extracted at a velocity such that 3He cannot return backwards to raise the content of 3He in 4He and consequently to make it less capable of dissolving the liquid 3He. In the system of the prior art, it is instinctively guessed that it would be necessary to prefer a wide discharge conduit, where the velocity of travel will be low, in fact, the 4He remains practically stagnant. On the other hand, the discharge conduit of a cryostat according to the present invention will be, preferably, narrow, and the velocity of travel relatively high.

The invention will now be described in greater detail with the aid of a practical example, illustrated with the aid of the single FIGURE which is in a diagrammatic cross-section, of an experimental cryostat in accordance with the invention.

The cold part of the cryostat alone is shown in the FIGURE. The unit is included in an enclosure 1 cooled to the temperature of 1.8° K. The two isotopes 3He and 4He arrive into the enclosure via capillaries 2 and 3 respectively, in liquid phase and under a pressure in the region of ½ atmosphere. The mixture leaves the enclosure again via a capillary 4. In the cryostat described here, these three capillaries have an internal diameter of 0.3 mm. A heat exchanger 5 consists of three capillaries 2A, 3A, and 4A made of CuNi with an internal diameter of 0.1 mm and an external diameter of 0.5 mm. which are tin-soldered together over their entire length and connected, on the one hand, to the capillaries 2 to 4 and, on the other hand, to the mixing box. Mixing of the two components takes place in the copper mixing box 6 of a very small capacity (a few cubic millimeters) whose wall is coated with sintered silver powder in order to increase its exchange surface area. A thermometer 7, consisting of a germanium resistor is screwed into the outside of this box.

Two different assemblies have been employed to test this cryostat. The first consists of a conventional cryostat which enables a temperature close to 1.8° K. to be obtained by pumping a bath of 4He. In this helium bath is immersed a vacuum enclosure 1 containing the cold part of the cryostat described above. The two pure isotopes of helium are injected into the cryostat in gaseous form at a rate which is controlled by two flow regulators. These gases are liquefied with the aid of exchangers in the main helium bath before being directed into the cold enclosure 1.

The second device is a rotating cryostat operating by continuous circulation of 4He from a stationary reservoir. Rotation is obtained with the aid of a horizontal rotating coupling in the liquid 4He feed line. This cryostat enables an exchanger to be cooled to a temperature close to 1.6° K. by pumping 4He and by using a cold decompression valve. The enclosure 1 containing the mixing chamber is fixed on to this exchanger. The two isotopes of helium are injected in gaseous form and are then cooled and liquefied in the helium vapours of the main circulation.

The operation of a system of this kind requires a continuous supply of 3He. In view of the price of this isotope it is preferable to recover the dilute mixture leaving the cryostat and to separate its two constituents. To do this, an adjoining distillation unit has been employed, operating in a separate cryostat and enabling the two isotopes to be obtained in a purity better than 99% in the case of 3He and 99.99% in the case of 4He. This unit, which employs only well-known techniques, has not been described.

Using the cryostat in the form described, a stable temperature of less than 180 mK and completely insensitive to the orientation of the system relative to the vertical has been obtained.

It is advantageous to employ, in the exchanger, capillaries of smaller diameter in the warm part than in the cold part. In another embodiment, the use of a two-part exchanger, the warmer part being made with 0.05 mm tubing and the other with 0.2 mm tubing, has made it possible to obtain a temperature of 125 mK with flow rates of 9 ml/mm in the case of 3He and of 90 ml/min in the case of 4He (NTP gas flow rate). This corresponds to linear velocities of approximately 10 cm/s. It has been observed that, if the diameter increases, the critical velocity decreases, at least within certain limits. In principle, nothing prevents lower temperatures, below 100 mK, being obtained. The flow rates employed are sufficiently low to envisage the use of the system in a satellite. In fact, under these operating conditions, the consumption over one year is 5 liters of 3He and 50 liters of 4He (liquid).

The system actually looks very simple but, as far as the inventor is aware, such a cryostat has never been proposed. The reason is that this system operates only out of equilibrium, at well-defined flow rates, corresponding to the tubing diameters. Understanding of the operation of this system makes it necessary, furthermore, to take into account the mutual friction between the superfluid 4He and the 3He, a phenomenon which has only recently become known.

Two very different cases of use may be envisaged:

the use of a system of this kind in space appears highly promising because the reliability of the system can be extremely good owing to its simplicity. In fact, in an application of this kind, the two isotopes are initially taken on board in liquid form and the mixture is discharged into space (it could also be stored as such, in the case of a recoverable device). In principle, therefore, a system of this kind requires no pumping system (only a flow control system is needed). The absence of cold decompression (in contrast to traditional systems) makes it possible, moreover, to get rid of blockage problems due to impurities in the helium, in normal conditions (on Earth) this system applies in all cases where a high mobility and a small bulk are sought after. In fact, on the one hand, the cryostat is insensitive to gravity (no liquid-gas phase separation surface) and, on the other hand, the only external connections are effected by three capillaries less than one millimeter in diameter. In particular, a system of this kind can be mounted on a carrier which can be pointed in all directions. However, in view of the price of 3He, it is necessary in this case to employ an appended distillation unit, as described above.

I claim:

1. A process for obtaining very low temperatures which comprises the steps of:

(a) providing a mixing box, (b) continuously supplying liquid 4He and liquid 3He in separate streams into said mixing box in proportions such that a two-phase system comprising a solution phase of 3He dissolved in liquid 4He and a liquid phase consisting of pure 3He are formed in said mixing box, said solution phase containing 3He at a predetermined level, (c) extracting a stream of said solution phase from said mixing box at a sufficiently high velocity that the 3He in said stream cannot substantially diffuse in countercurrent fashion back into the solution phase in said mixing box to thereby reduce the amount of 3He from said stream of 3He supplied to said mixing box which dissolves in the 4He from said stream of 4He supplied to said mixing box in providing said solution phase.

2. A process according to claim 1, wherein said mixing box provided in step (a) includes a discharge conduit for said stream of solution phase extracted in step (c) which has an internal diameter ob 0.1 mm and wherein in step (c) the stream of said solution phase is extracted at a velocity of about 10 cm/s.

3. A process according to claim 2, including the steps of positioning said mixing box in an evacuated enclosure and discharging said stream of solution phase to an environment around said evacuated enclosure.

4. A process according to claim 1, including a step (d) of distilling said stream of solution phase to recover 3He and 4He.

5. A process according to claim 4, including a step of recycling the 3He and 4He recovered in step (d) for use in step (b).

6. A process according to claim 4, including a step of storing the 3He and 4He recovered in step (d).

7. Apparatus for obtaining very low temperatures which comprises:

an evacuated enclosure means, a mixing box having a small capacity positioned in said evacuated enclosure means, and first, second and third capillaries which extend out of said mixing box and which are soldered together, said first and second capillaries functioning to supply streams of 3He and 4 He, respectively, into said mixing box, and said third capillary functioning to extract a stream of a solution phase of 3He dissolved in liquid 4He from said mixing box.

8. Apparatus according to claim 7, wherein said third capillary is connected to a distillation unit for separating 3He and 4He from said stream of solution phase.

* * * * *